US011903470B1

(12) United States Patent
Feng

(10) Patent No.: US 11,903,470 B1
(45) Date of Patent: Feb. 20, 2024

(54) LUGGAGE CASE

(71) Applicant: Tan Feng, Jiaxing (CN)

(72) Inventor: Tan Feng, Jiaxing (CN)

( * ) Notice: Subject to any disclaimer, the term of this patent is extended or adjusted under 35 U.S.C. 154(b) by 0 days.

(21) Appl. No.: 18/453,310

(22) Filed: Aug. 22, 2023

(30) Foreign Application Priority Data

Aug. 26, 2022 (CN) ..... 202222280888.1

(51) Int. Cl.
*A45C 13/28* (2006.01)
*A45C 13/26* (2006.01)
*A45C 5/03* (2006.01)

(52) U.S. Cl.
CPC ..... *A45C 13/28* (2013.01); *A45C 5/03* (2013.01); *A45C 13/262* (2013.01); *A45C 2013/267* (2013.01)

(58) Field of Classification Search
CPC ..... A45C 13/28; A45C 2200/20; A45C 2013/267; A45C 13/262; A45C 5/03
See application file for complete search history.

(56) References Cited

U.S. PATENT DOCUMENTS 11,547,229 B1 * 1/2023 Soares De Oliveira ..... A45C 11/182
2020/0077761 A1 * 3/2020 McKelvey ..... A47G 25/1442
2021/0282520 A1 * 9/2021 Weng ..... A45C 13/262

FOREIGN PATENT DOCUMENTS

CA 2950503 A1 * 6/2018 ..... A45C 13/00

* cited by examiner

*Primary Examiner* — Sue A Weaver
(74) *Attorney, Agent, or Firm* — Zhigang Ma

(57) ABSTRACT

A luggage case is provided, and the luggage case includes a case body, a pull rod assembly, and a placing assembly. The placing assembly includes a fixing plate fixedly connected to the pull rod assembly and a rotatable plate rotatably connected to the fixing plate. The case body is provided with a first accommodating cavity, and the pull rod assembly is telescopically connected to the case body; in a situation that the pull rod assembly contracts, the placing assembly enters the first accommodating cavity, and in a situation that the pull rod assembly extends, the placing assembly extends out of the first accommodating cavity. When the pull rod assembly contracts into the case body, the placing assembly is located in the first accommodating cavity, the luggage case is designed artistically, and the placing assembly does not contact with external objects to prevent the placing assembly from being damaged.

12 Claims, 3 Drawing Sheets

LUGGAGE CASE

TECHNICAL FIELD

The disclosure relates to the technical field of luggage cases, in particular to a luggage case.

BACKGROUND

Traveling is a way for more and more people to spend their spare time, adjust their work and life, and increase their experience. In the process of traveling, a durable luggage case is often a must for people. When people are waiting for a bus, a luggage case is put aside, sometimes books, cups, fast food, objects and the like are put on the upper surface of the luggage case, and an uneven upper surface of the luggage case often causes the objects on the luggage case to fall off easily.

Some existing luggage cases also have a folding plate installed on the case body, which can be opened when needed to place objects on the folding plate. However, the folding plate on the case body can cause an overall size of the luggage case to be too large, and the folding plate is prone to damage due to collision with external objects.

SUMMARY

A purpose of the disclosure is to provide a luggage case to solve the technical problems that a folding plate on a case body of the prior art can make an overall size of the luggage case to be too large, and the folding plate is prone to damage due to collision with external objects.

The disclosure provides a luggage case which includes a case body, a pull rod assembly, and a placing assembly.

The placing assembly includes a fixing plate fixedly connected to the pull rod assembly and a rotatable plate rotatably connected to the fixing plate.

The case body is provided with a first accommodating cavity, and the pull rod assembly is telescopically connected to the case body; in a situation that the pull rod assembly is in a contracted state, the placing assembly enters the first accommodating cavity, and in a situation that the pull rod assembly is in an extended state, the placing assembly extends out of the first accommodating cavity.

In an embodiment, the fixing plate is provided with a first accommodating groove, and the rotatable plate is capable of being accommodated in the first accommodating groove and is rotatably connected to left and right groove walls of the first accommodating groove.

In an embodiment, the placing assembly further includes at least one rotatable cup holder, and the rotatable cup holder is arranged on the fixing plate and is rotatably connected to the fixing plate.

In an embodiment, the rotatable cup holder is located in the first accommodating groove and is rotatably connected to a bottom of the first accommodating groove. A second accommodating groove is defined at a side of the rotatable plate facing towards the fixing plate, a second accommodating cavity is defined by the second accommodating groove and the bottom of the first accommodating groove, and the second accommodating cavity is configured to accommodate at least one rotatable cup holder.

In an embodiment, each rotatable cup holder includes a holder body and a limiting rib, the holder body is provided with a limiting through hole (11) for inserting a cup therein, the bottom of the first accommodating groove is provided with opposite connecting bases, and the holder body is arranged between the opposite connecting bases and is rotatably connected to the opposite connecting bases. The bottom of the first accommodating groove is further provided with at least one limiting groove corresponding to the at least one rotatable cup holder, the limiting rib is connected to a side of the holder body facing towards the bottom of the first accommodating groove and the limiting rib is located in a corresponding one of the at least one limiting groove, and the limiting rib and the corresponding one limiting groove are configured to cooperate with each other to limit a rotation angle of the holder body.

In an embodiment, the fixing plate is provided with at least one hanging part for hanging external objects.

In an embodiment, a protrusion is provided on a side of the fixing plate facing away from the case body, the protrusion is protruded in a telescopic direction of the pull rod assembly (2), and the protrusion forms one of the at least one the hanging part.

In an embodiment, the pull rod assembly includes a handle and at least one rod body. An end of each of the at least one rod body is telescopically connected to the case body, the other end of the rod body is connected to the at least one handle, the placing assembly is fixedly connected to the rod body, and a space is defined between the placing assembly and the handle.

In an embodiment, the at least one rod body is two in number, two opposite ends of the handle are respectively connected to the two rod bodies, and the placing assembly is arranged between the two rod bodies.

In an embodiment, the pull rod assembly is disposed on a side of the case body, the fixing plate comprises a first side facing towards the case body and a second side facing away from the case body, and at least one of the first side and the second side is provided with the rotatable plate.

Compared with the related art, the disclosure has following technical effects:

The luggage case of the disclosure includes a case body, a pull rod assembly, and a placing assembly; the placing assembly includes a fixing plate fixedly connected to the pull rod assembly and a rotatable plate rotatably connected to the fixing plate; and the case body is provided with a first accommodating cavity, and the pull rod assembly is telescopically connected to the case body; in a situation that the pull rod assembly is in a contracted state, the placing assembly enters the first accommodating cavity, and in a situation that the pull rod assembly is in an extended state, the placing assembly extends out of the first accommodating cavity.

The placing assembly is fixed on the pull rod assembly and moves synchronously with the pull rod assembly, so that the whole case body is not oversize. When the pull rod assembly contracts into the case body, the placing assembly is located in the first accommodating cavity, so that the luggage case is designed artistically, and the placing assembly does not contact with external objects to prevent the placing assembly from being damaged. When an object needs to be placed, only the pull rod assembly is needed to be pulled out to extend, the placing assembly extends out from the first accommodating cavity with the movement of the pull rod assembly, and the rotatable plate is rotated and flipped relative to the fixing plate, so that the object can be placed on the rotatable plate, and the object is placed stably and is not easy to fall off. After the use of the rotatable plate is completed, the rotatable plate is rotated to be buckled with the fixing plate relatively, meanwhile, the movement of the case body pulled by the pull rod assembly is not affected and the rotatable plate is not easy to collide with the external objects.

Other features and advantages of the disclosure will be described in detail in the following embodiments.

BRIEF DESCRIPTION OF DRAWINGS

In order to provide a clearer explanation of the specific embodiments of the disclosure or technical solutions in the related art, the following will briefly introduce the drawings required for describing the specific embodiments or the related art. It is apparent that the drawings in the following description are some embodiments of the disclosure. For those of ordinary skill in the art, other drawings can be obtained based on these drawings.

DESCRIPTION OF REFERENCE NUMERALS

Figure 1:
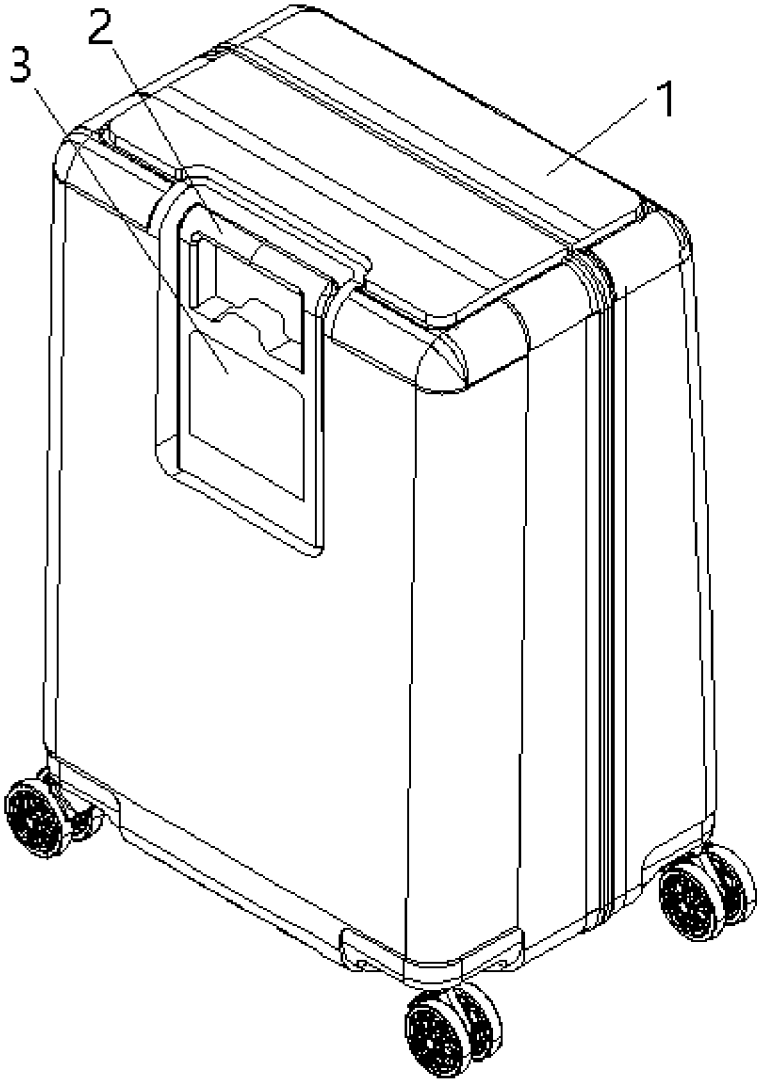
FIG. 1 is a schematic view of a luggage case when a pull rod assembly is in a contracted state according to an embodiment of the disclosure.

1—case body; 2—pull rod assembly; 3—placing assembly; 4—fixing plate; 5—rotatable plate; 6—first accommodating groove; 7—rotatable cup holder; 8—second accommodating groove; 9—holder body; 10—limiting rib; 11—limiting through hole; 12—connecting base; 13—limiting groove; 14—protrusion; 15—rod body; 16—handle.

DETAILED DESCRIPTION OF EMBODIMENTS

The technical solution of the disclosure will be clearly and completely described below in combination with the embodiments. Apparently, the described embodiments are part of the embodiments of the disclosure, but not all of them. Based on the described embodiments of the disclosure, all other embodiments obtained by those of ordinary skill in the art without creative work should belong to the scope of protection of the disclosure.

In the description of the disclosure, it should be noted that orientation or positional relationships indicated by terms such as "center", "upper", "lower", "left" and "right" are based on the orientation or positional relationships shown in the drawings, these terms are only for the convenience of describing the utility model and simplifying the description. These terms do not indicate or imply that a device or element referred to must have a particular orientation, be constructed and operate in a particular orientation, and thus these terms should not be considered as a limitation to the disclosure. Furthermore, terms "first", "second", and "third" are only used for descriptive purposes and should not be considered as indicating or implying relative importance.

In the description of the disclosure, unless otherwise specified and limited it should be noted that terms "installation" and "connection" should be interpreted in a broad sense, for example, they can be considered as a fixed connection, a detachable connection, or an integrated connection; they can be a mechanical connection or an electrical connection; they can be a direct connection or an indirect connection through an intermediate medium, and they can be an internal communication of two components. For those of ordinary skill in the art, the specific meanings of the above terms in the disclosure can be understood in detail.

In addition, the technical solutions of the various embodiments may be combined with each other, but must be based on a fact that those of ordinary skill in the art can realize them. When the combination of the technical solutions is contradictory or cannot be realized, it should be considered that such combination of technical solutions does not exist, and is not within the scope of protection claimed by the disclosure.

The disclosure is further described in detail below through specific embodiments and in combination with the drawings.

Figure 2:
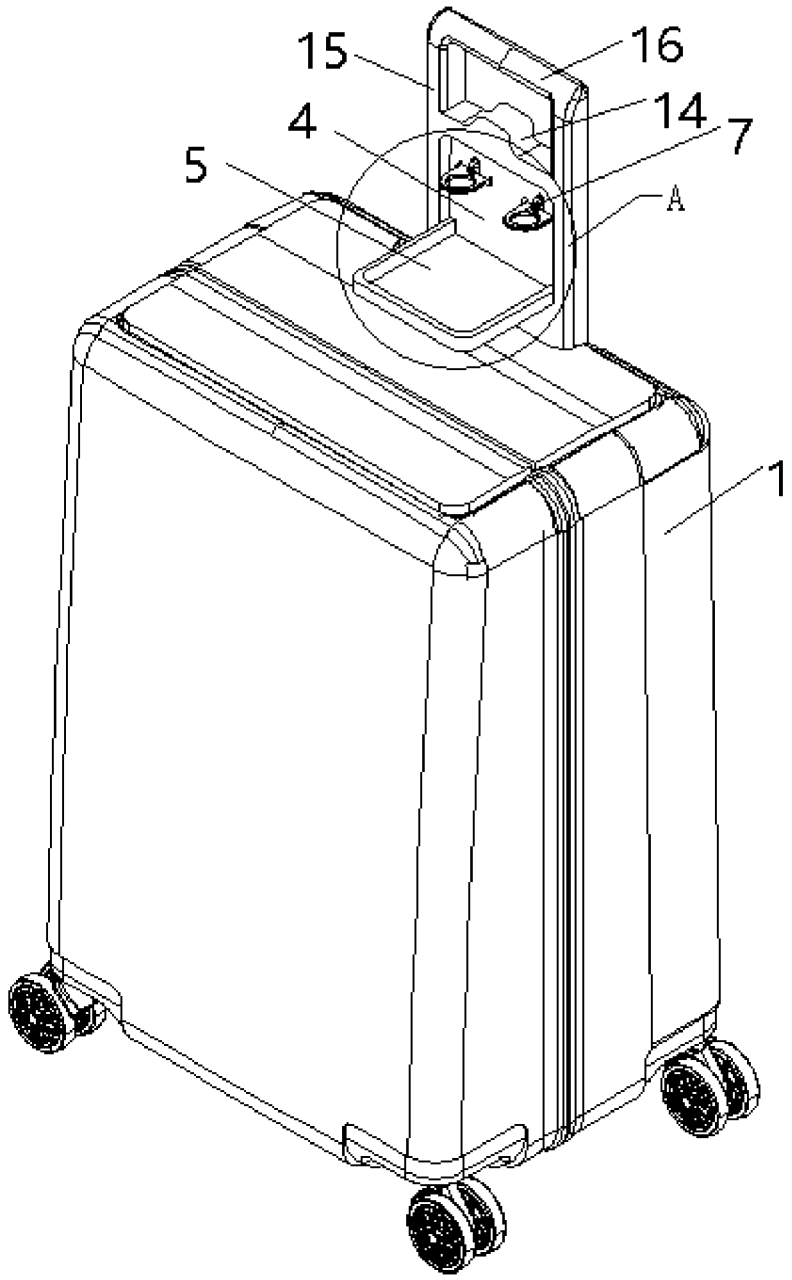
FIG. 2 is a schematic view of the luggage case when the pull rod assembly extends out and a rotatable plate and a rotatable cup holder are opened.
Figure 3:
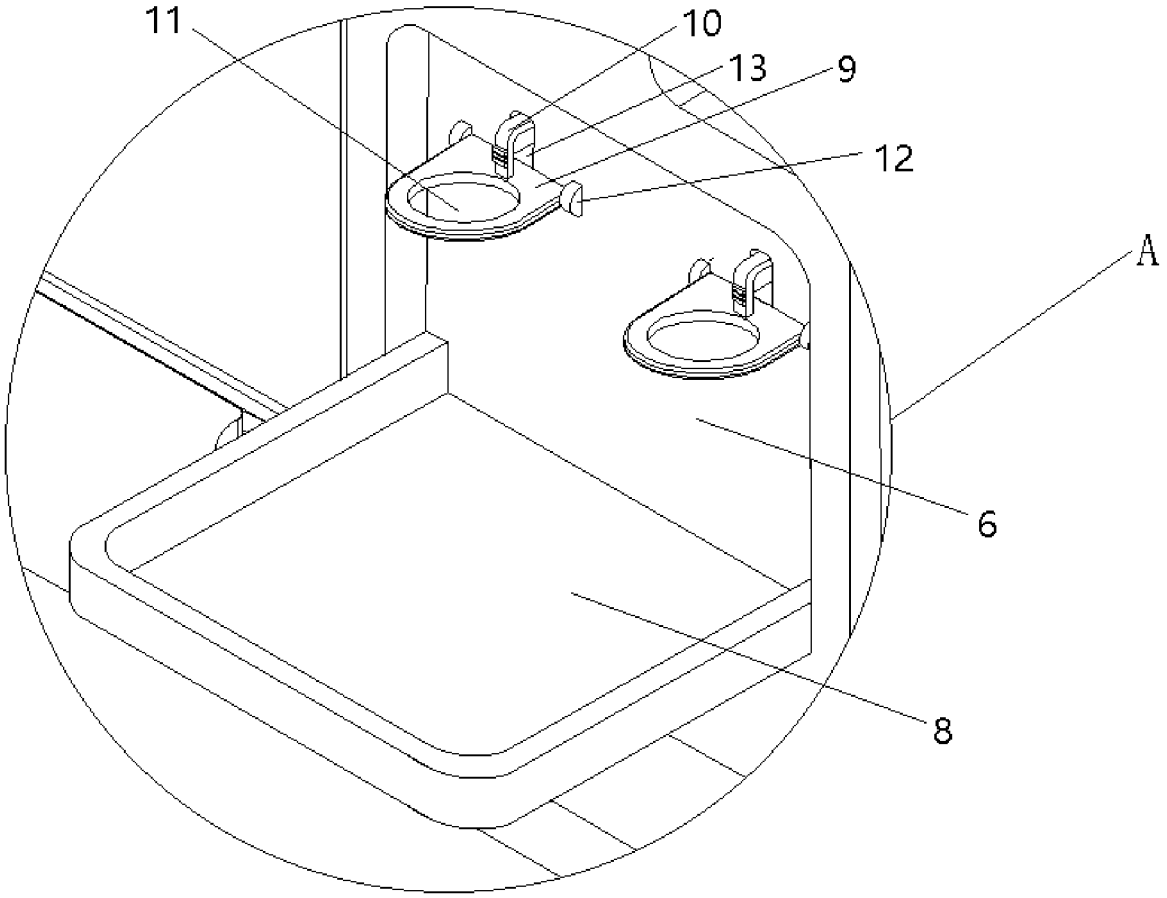
FIG. 3 is an enlarged view of position A in FIG. 2 according to the embodiment of the disclosure.

A specific structure of the disclosure is shown in FIGS. 1-3.

A luggage case is provided according to an embodiment by the disclosure, including a case body 1, a pull rod assembly 2, and a placing assembly 3. The placing assembly 3 includes a fixing plate 4 fixedly connected to the pull rod assembly 2 and a rotatable plate 5 rotatably connected to the fixing plate 4. The case body 1 is provided with a first accommodating cavity, and the pull rod assembly 2 is telescopically connected to the case body 1; in a situation that the pull rod assembly 2 is in a contracted state, the placing assembly 3 may enter the first accommodating cavity, and in a situation that the pull rod assembly 2 is in an extended state, the placing assembly 3 may extend out of the first accommodating cavity.

The placing assembly 3 is fixed on the pull rod assembly 2 and moves synchronously with the pull rod assembly 2, so that the whole case body 1 is not oversize. When the pull rod assembly 2 contracts into the case body 1, the placing assembly 3 is located in the first accommodating cavity, so that the whole case body 1 is designed artistically, and the placing assembly 3 does not contact with external objects to prevent the placing assembly 3 from being damaged. When an object needs to be placed, only the pull rod assembly 2 is needed to be pulled out to extend, the placing assembly 3 extends out from the first accommodating cavity with the movement of the pull rod assembly 2, and the rotatable plate 5 is rotated and flipped relative to the fixing plate 4, so that the object can be placed on the rotatable plate 5, and the object is placed stably and is not easy to fall off. After the use the rotatable plate 5 is completed, the rotatable plate 5 is rotated to be buckled with the fixing plate 4 relatively, meanwhile, the movement of the case body 1 pulled by the pull rod assembly 2 is not affected and the rotatable plate 5 is not easy to collide with the external objects.

Furthermore, the fixing plate 4 is provided with a first accommodating groove 6, and the rotatable plate 5 is capable of being accommodated in the first accommodating groove 6 and is rotatably connected to left and right groove walls of the first accommodating groove 6.

In the embodiment, two sides of a lower end of the rotatable plate 5 are rotatably connected to lower ends of the left and right groove walls of the first accommodating groove 6. When the rotatable plate 5 is not in use, the rotatable plate 5 is rotated to be completely accommodated in the first accommodating groove 6, and a surface of the rotatable plate 5 facing away from the first accommodating groove 6 is flush with or lower than a groove of the first accommodating groove 6, so that the rotatable plate 5 may not affect the placing assembly 3 enter the first accommodating cavity; meanwhile, the rotatable plate 5 completely enters the first accommodating groove 6, so that damages caused by collision of external objects may be effectively prevented. When the rotatable plate 5 is needed to be used, the rotatable plate 5 is rotated to be opened; after the rotatable plate 5 is rotated at a certain angle, a groove wall at a lower end of the first accommodating groove 6 can limit the rotatable plate 5 to continue to be rotated, and at this time, the rotatable plate 5 is relatively horizontal, so that the object can be conveniently and stably placed.

In an embodiment, the placing assembly 3 further includes at least one rotatable cup holder 7, and the rotatable cup holder 7 is arranged on the fixing plate 4 and is rotatably connected to the fixing plate 4. When a water cup is needed to be placed, the rotatable cup holder 7 is rotated to be open, and the water cup can be placed on the rotatable cup holder 7. It is convenient to use and enhances the functional diversity of the placing assembly 3; at the same time, the rotatable cup holder 7 can be flipped and buckled with the fixing plate 4 when not in use, thereby saving space and avoiding damages.

In an embodiment, the rotatable cup holder 7 is located in the first accommodating groove 6 and is rotatably connected to a bottom of the first accommodating groove 6. A second accommodating groove 8 is defined at a side of the rotatable plate 5 facing towards the fixing plate 4, a second accommodating cavity is defined by the second accommodating groove 8 and the bottom of the first accommodating groove 6, and the second accommodating cavity is configured to accommodate at least one rotatable cup holder 7.

In the embodiment, when the rotatable cup holder 7 is needed to be used, the rotatable plate 5 is needed to be opened first, and then the rotatable cup holder 7 is opened. At this time, the rotatable plate 5 is located below the rotatable cup holder 7, and when a water cup is placed on the rotatable cup holder 7, the rotatable plate 5 can support the cup, thereby improving the stability of placing the water cup. After the use of the rotatable cup holder 7 is completed, the rotatable cup holder 7 is only needed to be buckled with the bottom of the first accommodating groove 6, and the rotatable plate 5 is rotated into the first accommodating groove 6, so that the rotatable cup holder 7 is accommodated in the second accommodating cavity; and the rotatable cup holder 7 can be effectively protected from being damaged. In addition, since the second accommodating groove 8 is defined on the rotatable plate 5, the object can be placed in the second accommodating groove 8, and the groove wall of the second receiving groove 8 can prevent the object from falling down.

The embodiment is not limited to this, the rotatable cup holder 7 can be disposed on a side of the fixing plate 4 facing away from the rotatable plate 5; at this time, the water cup can be placed on the rotatable plate 5 separately.

In an embodiment, each rotatable cup holder 7 includes a holder body 9 and a limiting rib 10, and the holder body 9 is provided with a limiting through hole 11 for inserting a cup therein. After the cup is placed in the limiting through hole 11, the rotatable plate 5 can support a bottom of the cup, and the limiting through hole 11 can limit shaking of the cup, the structure is simple, and the cup is stable when placed. The bottom of the first accommodating groove 6 is provided with opposite connecting bases 12, and the holder body 9 is arranged between the opposite connecting bases 12 and is rotatably connected to the opposite connecting bases 12. The bottom of the first accommodating groove 6 is further provided with limiting grooves 13. The limiting rib 10 is in a "L" shape, an end of the limiting rib 10 is connected to a side of the holder body 9 facing the bottom of the first accommodating groove 6, the other end of the limiting rib 10 is disposed in a corresponding one of the limiting grooves 13, and the limiting rib 10 is located below the limiting through hole 11. When the rotatable cup holder 7 is opened, the other end of the limiting rib 10 located in the corresponding limiting groove 13 is mutually matched and abutted with the corresponding limiting groove 13 to limit the holder body 9 to continue to be rotated; specifically, when the holder body 9 is relatively opened, the other end of the limiting rib 10 located in the corresponding limiting groove 13 is abutted with the corresponding limiting groove 13 to be relatively horizontal, the end of the limiting rib 10 is relatively vertical at the same time, and thus the holder body 9 is relatively horizontal facilitates placing the cup. When the holder body 9 is buckled relatively, the other end of the limiting rib 10 located in the corresponding limiting groove 13 is relatively vertical, and the end of the limiting rib 10 is relatively horizontal and located in the corresponding limiting groove 13, so that the holder body 9 can be relatively vertical and abutted with the bottom of the limiting groove 13, the structure is compact, the occupied space is reduced, the space utilization rate is improve, and thus the holder body 9 is conveniently accommodated in the second accommodating cavity.

In an embodiment, the rotatable cup holder 7 has a number of two, but it is not limited to this and can be set in any number as needed.

In an embodiment, the fixing plate 4 is provided with at least one hanging part for hanging external objects. By using the hanging part, a user can hang external objects such as small handbags, plastic bags, or handbags, making it convenient for the user to make phone calls, check tickets, enter the station, or buy things, thereby avoiding confusion. At the same time, the hanging part is disposed on the fixing plate 4, the hanging part and the fixing plate 4 can be stored together in the first accommodating cavity to avoid damages, and the whole structure of the luggage case is artistic.

In an embodiment, a protrusion 14 along a telescopic direction of the pull rod assembly 2 is provided on a side of the fixing plate 4 facing away from the case body 1, and the protrusion 14 forms the hanging part.

In the embodiment, an upper end of the fixing plate 4 is provided with the protrusion 14, and the protrusion 14 is located in a middle of the upper end of the fixing plate 4. A hanging function is achieved through the protrusion 14, with a simple structure and convenient production.

The embodiment is not limited to this, and multiple protrusions 14 may be provided, and the multiple protrusions 14 may be distributed at intervals on the upper end of the fixing plate 4, as long as the requirements are met.

In an embodiment, the pull rod assembly 2 includes a handle 16 and at least one rod body 15; an end of the rod body 15 is telescopically connected to the case body 1, the other end of the rod body 15 is connected to the handle 16, the placing assembly 3 is fixedly connected to the rod body 15, and there is a space between the placing assembly 3 and the handle 16.

In the embodiment, the pull rod assembly 2 may include a rod body 15, a lower end of the rod body 15 is telescopically connected to the case body 1, an upper end of the rod body 15 is connected to the handle 16, the fixing plate 4 is fixed on the rod body 15, and there is a space between the fixing plate 4 and the handle 16, so that the handle 16 can be conveniently held, and the overall structure is simple. The pull rod assembly 2 may also include two rod bodies 15, the two rod bodies 15 are arranged in parallel, the two opposite ends of the handle 16 are respectively connected to the upper ends of the two rod bodies 15, the placing assembly 3 is disposed between the two rod bodies 15, the left end and the right end of the fixing plate 4 are connected to the two rod bodies 15, and the fixing plate 4 is stably fixed. The overall structure is more stable and reliable, and at the same time, there is a space between the fixing plate 4 and the handle 16, so that on one hand, the handle 16 can be conveniently held, and on the other hand, the external object can be conveniently hung on the protrusion 14.

In an embodiment, the pull rod assembly 2 is disposed on a side of the case body 1, the fixing plate 4 defines a first side facing the case body 1 and a second side facing away from the case body 1, and at least one of the first side and the second side is provided with the rotatable plate 5. Specifically, the rotatable plate 5 is located on the side of the fixing plate 4 facing the case body 1. After the rotatable plate 5 is rotated and opened, the rotatable plate 5 and the case body 1 are located on the same side of the pull rod assembly 2, and the rotatable plate 5 is located on the upper side of the case body 1 to prevent the rotatable plate 5 from colliding with external objects.

In the embodiment, the pull rod assembly 2 and the placing assembly 3 are integrated by injection molding, with high structural strength and convenient production. At the same time, a height of the placing assembly 3 can be adjusted by adjusting the extension and contraction of the pull rod assembly 2 to meet the needs of the user. The User can pick up the objects on the placing assembly 3 without bending down, which is comfortable and convenient for the user.

Finally, it should be noted that the above embodiments are only used to illustrate the technical solutions of the disclosure, not to limit the disclosure. Although the disclosure has been described in detail with reference to the above embodiments, those of ordinary skill in the art should understand that they can still modify the technical solutions recorded in the above embodiments, or equivalently replace some or all of the technical features; and these modifications or replacements do not separate the essence of the corresponding technical solutions from the scope of the protection of this disclosure.

What is claimed is:

1. A luggage case, comprising: a case body (1), a pull rod assembly (2), and a placing assembly (3);

wherein the placing assembly (3) comprises a fixing plate (4) fixedly connected to the pull rod assembly (2) and a rotatable plate (5) rotatably connected to the fixing plate (4);

wherein the case body (1) is provided with a first accommodating cavity, and the pull rod assembly (2) is telescopically connected to the case body (1); in a situation that the pull rod assembly (2) is in a contracted state, the placing assembly (3) enters the first accommodating cavity, and in a situation that the pull rod assembly (2) is in an extended state, the placing assembly (3) extends out of the first accommodating cavity; and wherein the fixing plate (4) is provided with at least one hanging part for hanging external objects.

2. The luggage case as claimed in claim 1, wherein the fixing plate (4) is provided with a first accommodating groove (6), and the rotatable plate (5) is capable of being accommodated in the first accommodating groove (6) and is rotatably connected to left and right groove walls of the first accommodating groove (6).

3. The luggage case as claimed in claim 2, wherein the placing assembly (3) further comprises at least one rotatable cup holder (7), and the at least one rotatable cup holder (7) is arranged on the fixing plate (4) and is rotatably connected to the fixing plate (4).

4. The luggage case as claimed in claim 3, wherein the at least one rotatable cup holder (7) is located in the first accommodating groove (6) and is rotatably connected to a bottom of the first accommodating groove (6); and wherein a second accommodating groove (8) is defined at a side of the rotatable plate (5) facing towards the fixing plate (4), a second accommodating cavity is defined by the second accommodating groove (8) and the bottom of the first accommodating groove (6), and the second accommodating cavity is configured to accommodate the at least one rotatable cup holder (7).

5. The luggage case as claimed in claim 4, wherein each of the at least one rotatable cup holder (7) comprises a holder body (9) and a limiting rib (10), the holder body (9) is provided with a limiting through hole (11) for inserting a cup therein, the bottom of the first accommodating groove (6) is provided with opposite connecting bases (12), and the holder body (9) is arranged between the opposite connecting bases (12) and is rotatably connected to the opposite connecting bases (12); and the bottom of the first accommodating groove (6) is further provided with at least one limiting groove (13) corresponding to the at least one rotatable cup holder (7), the limiting rib (10) is connected to a side of the holder body (9) facing towards the bottom of the first accommodating groove (6) and the limiting rib (10) is located in a corresponding one of the at least one limiting groove (13), and the limiting rib (10) and the corresponding one limiting groove (13) are configured to cooperate with each other to limit a rotation angle of the holder body (9).

6. The luggage case as claimed in claim 1, wherein a protrusion (14) is provided on a side of the fixing plate (4) facing away from the case body (1), the protrusion (14) is protruded in a telescopic direction of the pull rod assembly (2), and the protrusion (14) forms one of the at least one hanging part.

7. The luggage case as claimed in claim 1, wherein the pull rod assembly (2) comprises a handle (16) and at least one rod body (15); and wherein an end of each of the at least one rod body (15) is telescopically connected to the case body (1), the other end of the rod body (15) is connected to the handle (16), the placing assembly (3) is fixedly connected to the at least one rod body (15), and a space is defined between the placing assembly (3) and the handle (16).

8. The luggage case as claimed in claim 7, wherein the at least one rod body (15) is two in number, two opposite ends of the handle (16) are respectively connected to the two rod bodies (15), and the placing assembly (3) is arranged between the two rod bodies (15).

9. The luggage case as claimed in claim 1, wherein the pull rod assembly (2) is disposed on a side of the case body (1), the fixing plate (4) comprises a first side facing towards the case body (1) and a second side facing away from the case body (1), and at least one of the first side and the second side is provided with the rotatable plate (5).

10. A luggage case, comprising: a case body (1), a pull rod assembly (2), and a placing assembly (3);

wherein the pull rod assembly (2) is disposed on a side of the case body (1), the pull rod assembly (2) is telescopically connected to the case body (1), the placing assembly (3) comprises a fixing plate (4) and a rotatable plate (5), the placing assembly is fixedly connected to the pull rod assembly (2) through the fixing plate (4), and the rotatable plate (5) is rotatably connected to the fixing plate;

wherein the fixing plate (4) comprises one or more rotatable cup holders (7), a first accommodating groove (6) is defined at a side of the fixing plate (4) facing towards the case body (1) and is configured to accommodate the one or more rotatable cup holders (7) and the rotatable plate (5); and wherein the fixing plate (4) further comprises one or more protrusions (14) on a side of the fixing plate (4) facing away from the case body (1), the protrusion (14) is protruded in a telescopic direction of the pull rod assembly (2).

11. The luggage case as claimed in claim 10, wherein a second accommodating groove (8) is defined at a side of the rotatable plate (5) facing towards the fixing plate (4).

12. A luggage case, comprising: a case body (1), a pull rod assembly (2), and a placing assembly (3);

wherein the placing assembly (3) comprises a fixing plate (4) fixedly connected to the pull rod assembly (2) and a rotatable plate (5) rotatably connected to the fixing plate (4);

wherein the case body (1) is provided with a first accommodating cavity, and the pull rod assembly (2) is telescopically connected to the case body (1); in a situation that the pull rod assembly (2) is in a contracted state, the placing assembly (3) enters the first accommodating cavity, and in a situation that the pull rod assembly (2) is in an extended state, the placing assembly (3) extends out of the first accommodating cavity;

wherein the fixing plate (4) is provided with a first accommodating groove (6), and the rotatable plate (5) is capable of being accommodated in the first accommodating groove (6) and is rotatably connected to left and right groove walls of the first accommodating groove (6);

wherein the placing assembly (3) further comprises at least one rotatable cup holder (7), and the at least one rotatable cup holder (7) is arranged on the fixing plate (4) and is rotatably connected to the fixing plate (4);

wherein the at least one rotatable cup holder (7) is located in the first accommodating groove (6) and is rotatably connected to a bottom of the first accommodating groove (6);

wherein a second accommodating groove (8) is defined at a side of the rotatable plate (5) facing towards the fixing plate (4), a second accommodating cavity is defined by the second accommodating groove (8) and the bottom of the first accommodating groove (6), and the second accommodating cavity is configured to accommodate the at least one rotatable cup holder (7);

wherein each of the at least one rotatable cup holder (7) comprises a holder body (9) and a limiting rib (10), the holder body (9) is provided with a limiting through hole (11) for inserting a cup therein, the bottom of the first accommodating groove (6) is provided with opposite connecting bases (12), and the holder body (9) is arranged between the opposite connecting bases (12) and is rotatably connected to the opposite connecting bases (12); and wherein the bottom of the first accommodating groove (6) is further provided with at least one limiting groove (13) corresponding to the at least one rotatable cup holder (7), the limiting rib (10) is connected to a side of the holder body (9) facing towards the bottom of the first accommodating groove (6) and the limiting rib (10) is located in a corresponding one of the at least one limiting groove (13), and the limiting rib (10) and the corresponding one limiting groove (13) are configured to cooperate with each other to limit a rotation angle of the holder body (9).

* * * * *